US010234824B2

(12) United States Patent
Chan

(10) Patent No.: US 10,234,824 B2
(45) Date of Patent: Mar. 19, 2019

(54) WATERPROOF SMART WATCH

(71) Applicant: Y.F. Company Limited, Dongguan, Guangdong (CN)

(72) Inventor: Yin Ning Chan, Guangdong (CN)

(73) Assignee: Y.F. Company Limited, Dongguan (CN)

( * ) Notice: Subject to any disclaimer, the term of this patent is extended or adjusted under 35 U.S.C. 154(b) by 141 days.

(21) Appl. No.: 15/376,692

(22) Filed: Dec. 13, 2016

(65) Prior Publication Data

US 2018/0129168 A1 May 10, 2018

(30) Foreign Application Priority Data

Nov. 7, 2016 (CN) ..... 2016 1 0978596

(51) Int. Cl.
*G04B 37/08* (2006.01)

(52) U.S. Cl.
CPC ..... *G04B 37/081* (2013.01)

(58) Field of Classification Search
CPC ..... G04B 37/081; G04B 37/08; G04G 17/02; H01H 13/06
USPC ..... 200/302.2
See application file for complete search history.

(56) References Cited

U.S. PATENT DOCUMENTS

2013/0155821 A1* 6/2013 Tsuji ..... G04B 37/0008 368/281

FOREIGN PATENT DOCUMENTS

WO WO2017188562 * 11/2017 ..... G04G 17/02
WO WO2017188562 A1 * 11/2017 ..... G04G 17/02

* cited by examiner

*Primary Examiner* — Edwin A. Leon
*Assistant Examiner* — Iman Malakooti

(57) ABSTRACT

The present application discloses a waterproof smart watch having a hollow watch case; a cell phone core mounted inside the watch case; a through-hole provided on a lateral side of the watch case and in communication with a microphone of the cell phone core; an adjusting knob rotatably mounted at the lateral side of the watch case, a communication aperture being provided on the adjusting knob and in communication with the through-hole; and a sealing pad being provided between the adjusting knob and the watch case, a small hole being provided on the sealing pad and in communication with the through-hole. The adjusting knob can be rotated to a position where the communication aperture, small hole and through-hole are in communication with one another successively, and further rotation of the adjusting knob renders the communication aperture and the through-hole being sealed and separated by the sealing pad.

9 Claims, 5 Drawing Sheets

WATERPROOF SMART WATCH

CROSS-REFERENCE TO RELATED APPLICATIONS

The present application claims the benefit of Chinese Patent Application No. 201610978596.1 filed on Nov. 7, 2016, the contents of which are hereby incorporated by reference.

FIELD OF THE TECHNOLOGY

The present application relates to an electronic product, and particularly to a waterproof smart watch with adjustable waterproof rating.

BACKGROUND

A traditional watch is usually formed by attaching a watch strap to a watch head. The watch head includes components such as watch case, watch movement, front glass cover, and bottom cover plate, etc. The front glass cover and the bottom cover plate are firmly coupled with the upper and lower sides of the watch case respectively by waterproof gaskets so as to pack the watch case into a sealed cavity. The watch movement is provided inside this sealed cavity. In the current smart wearing industry (especially smart watch), requirement of functions of smart wearing is getting higher and higher. For example, there is a need to add communication components such as microphone in a smart watch. However, a microphone requires basic communication with the outside through a communication aperture; otherwise the quality of communication cannot be ensured. Existing smart watches have great insufficiency, such as coarse design processing, lack of waterproof capacity, and low waterproof capacity. A smart watch is basically waterproof during everyday water-contacting activities (such as washing hands, taking a bath, etc.). However, it can only reach a waterproof rating of IPX8. Since the smart watch cannot reach a high waterproof rating, a user needs to take off the watch during deep water activities such as diving. This is rather troublesome, and the watch may be lost. If not, short circuit and damage of the watch may occur if water gets into the watch, and its original function cannot be achieved.

SUMMARY

In order to solve the above-mentioned problems, an object of the present application is to provide a waterproof smart watch with adjustable waterproof rating.

The waterproof smart watch of the present application can be realized by the following measures. A waterproof smart watch, characterized in having a hollow watch case; a cell phone core mounted inside the watch case; a through-hole provided on a lateral side of the watch case and in communication with a microphone of the cell phone core; an adjusting knob rotatably mounted at the lateral side of the watch case, a communication aperture being provided on the adjusting knob and in communication with the through-hole; and a sealing pad provided between the adjusting knob and the watch case, a small hole being provided on the sealing pad and in communication with the through-hole, and when the adjusting knob rotates to a position, the communication aperture, the small hole and the through-hole are in communication with one another successively, and further rotation of the adjusting knob renders the communication aperture and the through-hole being sealed and separated by the sealing pad.

As a preferred embodiment, an installation opening is provided on the lateral side of the watch case, and a circular tube is installed inside the installation opening, a center of the circular tube being provided with a stepped bore, wherein a large bore of the stepped bore is facing inwards and provided therein with a spring, and a bolt passes through and compresses the spring; the bolt extends from a small bore of the stepped bore and couples with a shaft of the adjusting knob after passing through the sealing pad, the through-hole being provided on the circular tube.

As a preferred embodiment, at least two sets of indentations are provided on the lateral side of the watch case surrounding the installation opening, and the adjusting knob is provided with projections that are engageable with one set of the indentations, and when the adjusting knob rotates such that the communication aperture, the small hole and the through-hole are in communication with one another successively, the projections snap into one set of the indentations; and when the adjusting knob rotates such that the communication aperture and the through-hole are sealed and separated by the sealing pad, the projections snap into another set of the indentations.

As a preferred embodiment, the adjusting knob is provided with a space facing the watch case and surrounding a portion of the circular tube that exposes out from the watch case.

As a preferred embodiment, a waterproof membrane covering the through-hole is provided inside the watch case.

As a preferred embodiment, an upper sealing cover of the watch case is provided with a transparent watch cover, and a lower sealing cover of the watch case is provided with a bottom cover.

As a preferred embodiment, a slot is provided on an outer end of the adjusting knob.

As a preferred embodiment, the adjusting knob is resiliently pressed against a surface of the sealing pad.

As a preferred embodiment, the adjusting knob is provided with "OPEN" and "LOCK" patterns, and when the communication aperture, the small hole and the through-hole are in communication with one another successively, the "OPEN" pattern is in an upright position and the "LOCK" pattern is in a toppled position; and when the communication aperture and the through-hole are sealed and separated by the sealing pad, the "LOCK" pattern is in an upright position and the "OPEN" pattern is in a toppled position.

As a preferred embodiment, the indentations include two sets of perpendicularly disposed indentations, and each set includes two axially symmetric indentations.

In the waterproof smart watch of the present application, one side of the watch case may be provided with a through-hole, which can be in communication with a microphone of the cell phone core provided inside the watch case. The through-hole may be directly formed on the watch case or formed on a component that is fixed on the watch case. Using the communication aperture on the adjusting knob, a user making a normal telephone call can direct the sound into the watch case through the communication aperture, the small hole and the through-hole so that the cell phone core inside the watch case can detect the sound, thereby effectively making the telephone call. Of course, a conventional waterproof membrane can be provided on the communication aperture or the through-hole to thereby ensure waterproof in normal condition. When performing deep water activities such as diving, the adjusting knob can be rotated so that the communication aperture and the through-hole are sealed and separated by the sealing pad. The sealing pad can be a soft rubber film. At the time of interruption of calls (normally it is not necessary to make a call in underwater activities), one can ensure the waterproof rating of the waterproof smart watch at a depth of over 100 meters, i.e. 10 ATM and above. In normal condition, a waterproof smart watch can make telephone calls and has a waterproof rating of IPX8. Rotation of the adjusting knob can adjust the waterproof rating up to 10 ATM and above.

DETAILED DESCRIPTION

Figure 1:
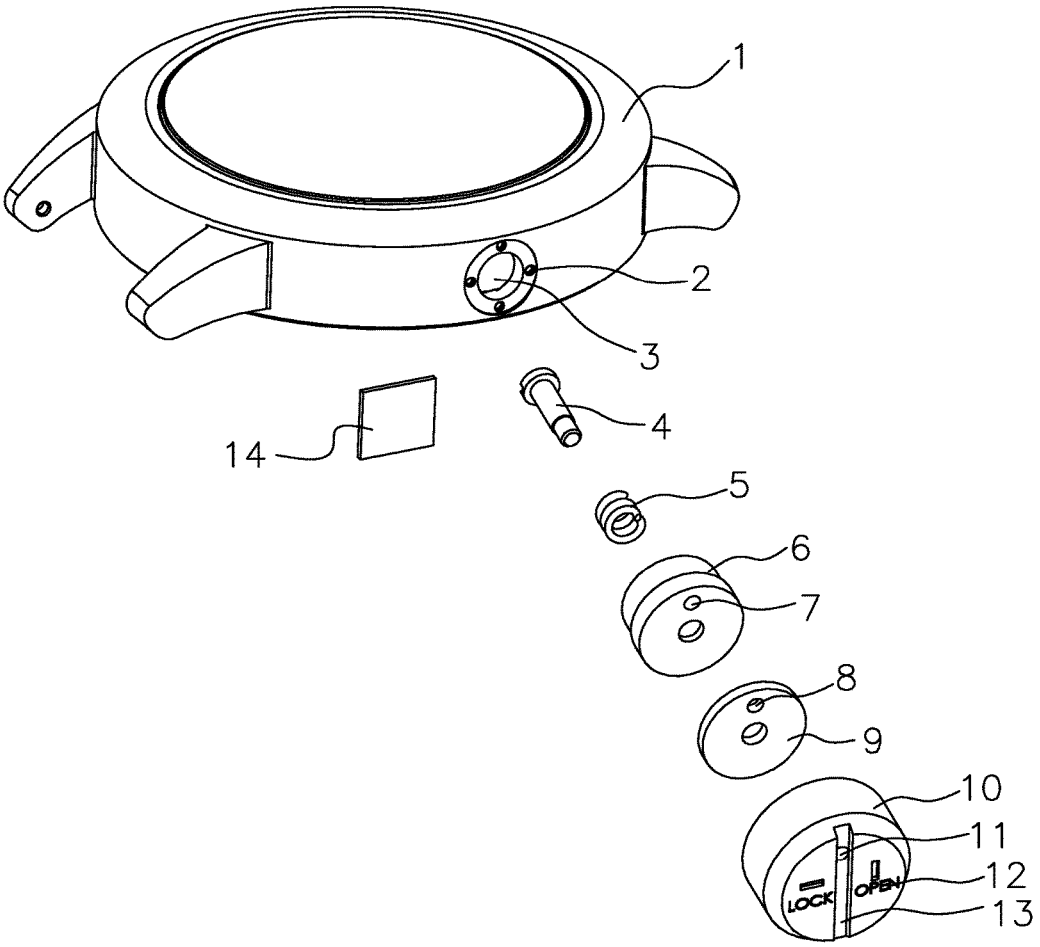
FIG. 1 is an exploded view of an embodiment of the waterproof smart watch of the present application.
Figure 2:
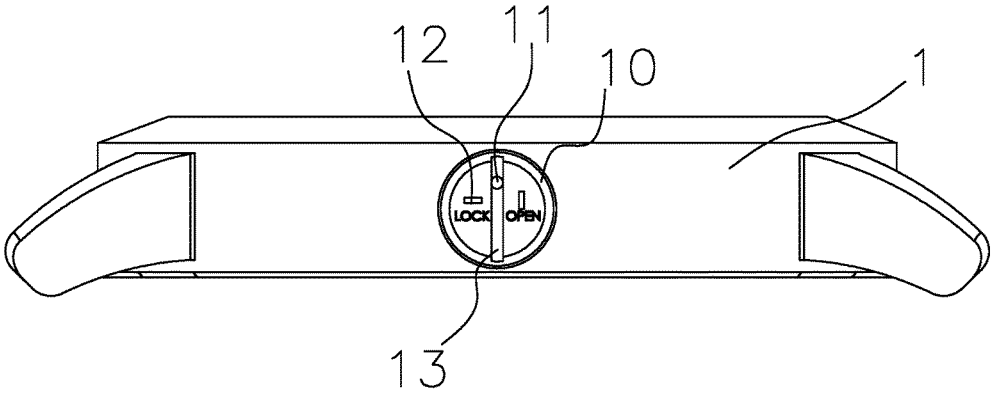
FIG. 2 is a side view of an embodiment of the waterproof smart watch of the present application in normal use.

Specific embodiments of the waterproof smart watch of the present application will now be described with reference to the accompanying drawings.

Referring to FIGS. 1-5, a waterproof smart watch may include a hollow watch case 1, and a cell phone core (not shown in the figures) being mounted inside the watch case 1. A through-hole 7 may be provided on a lateral side of the watch case 1. The through-hole 7 can be in communication with a microphone of the cell phone core. An adjusting knob 10 may be rotatably mounted at the lateral side of the watch case 1. A communication aperture 11 may be provided on the adjusting knob 10 and in communication with the through-hole 7. A sealing pad 9 may be provided between the adjusting knob 10 and the watch case 1. A small hole 8 may be provided on the sealing pad 9 and in communication with the through-hole 7. The adjusting knob 10 can be rotated to a position where the communication aperture 11, the small hole 8 and the through-hole 7 are in communication with one another successively, and further rotation of the adjusting knob 10 renders the communication aperture 11 and the through-hole 7 being sealed and separated by the sealing pad 9.

In the present waterproof smart watch, one side of the watch case 1 may be provided with a through-hole 7, which can be in communication with a microphone of the cell phone core provided inside the watch case 1. The through-hole 7 may be directly formed on the watch case or formed on a component that is fixed on the watch case. Using the communication aperture 11 on the adjusting knob 10, a user making a normal telephone call can direct the sound into the watch case through the communication aperture 11, the small hole 8 and the through-hole 7 so that the cell phone core inside the watch case can detect the sound, thereby effectively making the telephone call. Of course, a conventional waterproof membrane can be provided on the communication aperture 11 or the through-hole 7 to thereby ensure waterproof in normal condition. When performing deep water activities such as diving, the adjusting knob 10 can be rotated so that the communication aperture 11 and the through-hole 7 are sealed and separated by the sealing pad 9. The sealing pad 9 can be a soft rubber film. At the time of interruption of calls (normally it is not necessary to make a call in underwater activities), one can ensure the waterproof rating of the smart watch at a depth of over 100 meters, i.e. 10 ATM and above. In normal condition, the waterproof smart watch can make telephone calls and can have a waterproof rating of IPX8. Rotation of the adjusting knob 10 can adjust the waterproof rating up to 10 ATM and above.

Referring to the present embodiment of the waterproof smart watch shown in FIGS. 1-5, on the basis of the above-mentioned technical scheme and to facilitate processing and assembling, an installation opening 3 may be provided on the lateral side of the watch case 1, and a circular tube 6 may be installed inside the installation opening 3. A center of the circular tube 6 may be provided with a stepped bore. A large bore of the stepped bore facing inwards may be provided therein with a spring 5. A bolt 4 may pass through and compress the spring 5. The bolt 4 extends from a small bore of the stepped bore and couples with a shaft of the adjusting knob 10 after passing through the sealing pad 9. The through-hole 7 may be provided on the circular tube 6. Using the spring 5, the adjusting knob 10 can be resiliently pressed against an outer surface of the sealing pad 9.

Referring to the present embodiment of the waterproof smart watch shown in FIGS. 1-5, on the basis of the above-mentioned technical scheme, four indentations 2 can be evenly provided on the lateral side of the watch case 1 surrounding the installation opening 3, and the adjusting knob 10 can be provided with projections 17 that are engageable with the indentations 2. When the adjusting knob 10 rotates so that the communication aperture 11, the small hole 8 and the through-hole 7 are in communication with one another successively, the projections 17 may snap into the indentations 2 successively in one direction. When the adjusting knob 10 rotates 90 degrees so that the communication aperture 11 and the through-hole 7 are sealed and separated by the sealing pad 9, the projections may snap into the indentations 2 successively in another direction.

Referring to the present embodiment of the waterproof smart watch shown in FIGS. 1-5, on the basis of the above-mentioned technical scheme and for the sake of outer appearance, the adjusting knob 10 may be provided with a space facing the watch case 1 and surrounding a portion of the circular tube 6 that exposes out from the watch case.

Referring to the present embodiment of the waterproof smart watch shown in FIGS. 1-5, on the basis of the above-mentioned technical scheme and in a waterproof set up for normal communication, a waterproof membrane 14 covering the through-hole 7 may be provided inside the watch case 1.

Figure 3:
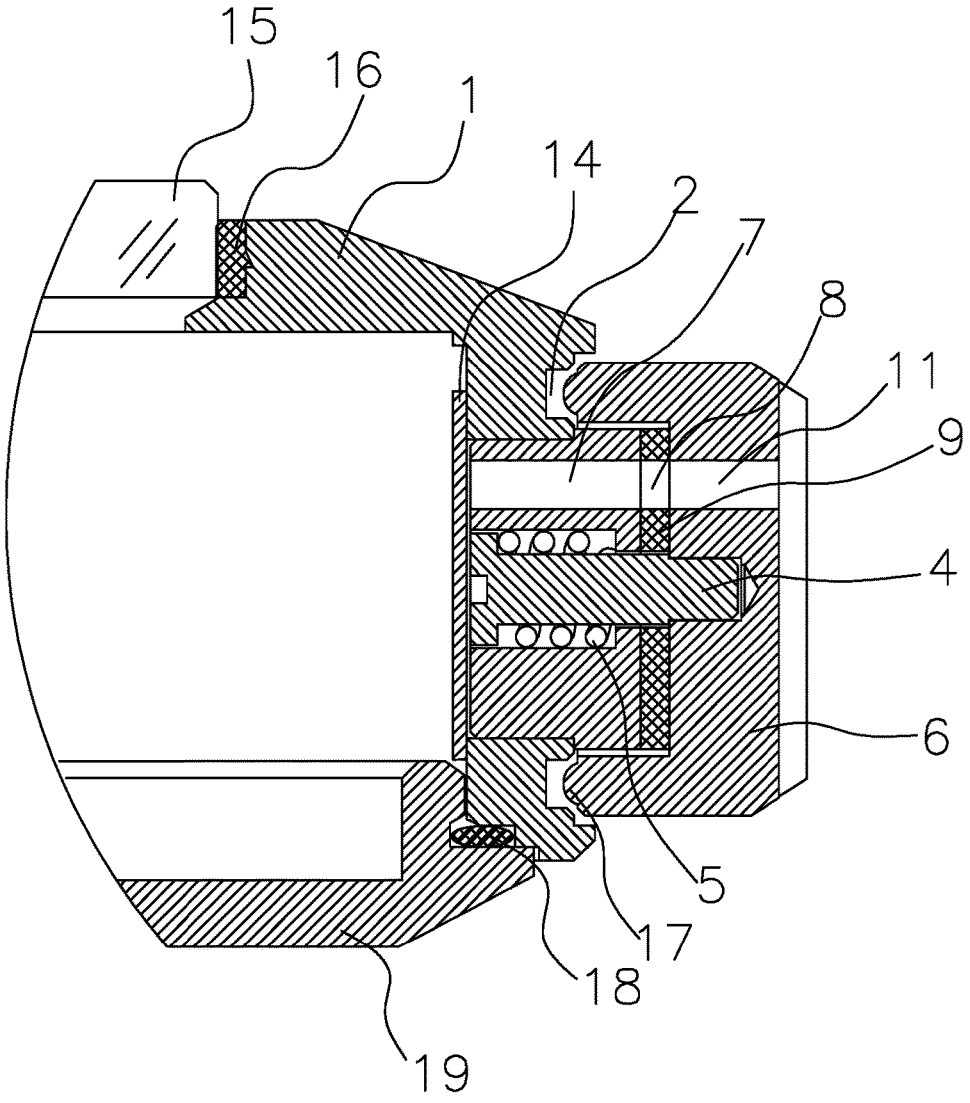
FIG. 3 is a partial cross sectional view of an embodiment of the waterproof smart watch of the present application provided with an adjusting knob in normal use.
Figure 4:
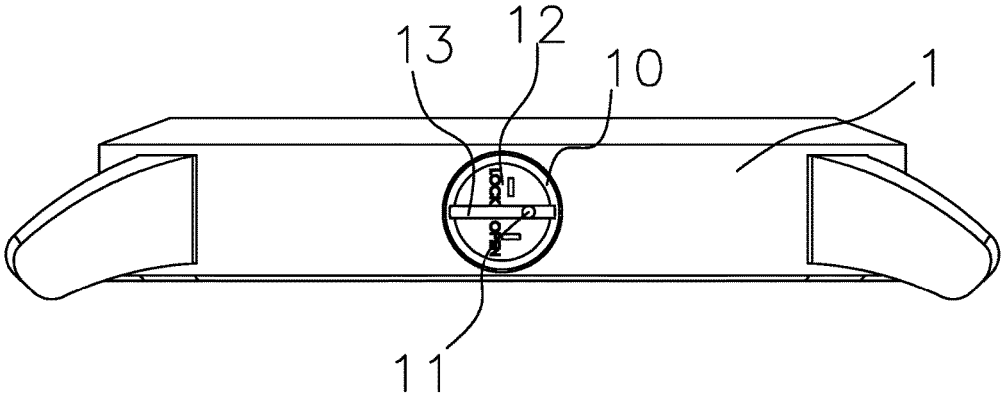
FIG. 4 is a side view of an embodiment of the waterproof smart watch of the present application for use in deep water.
Figure 5:
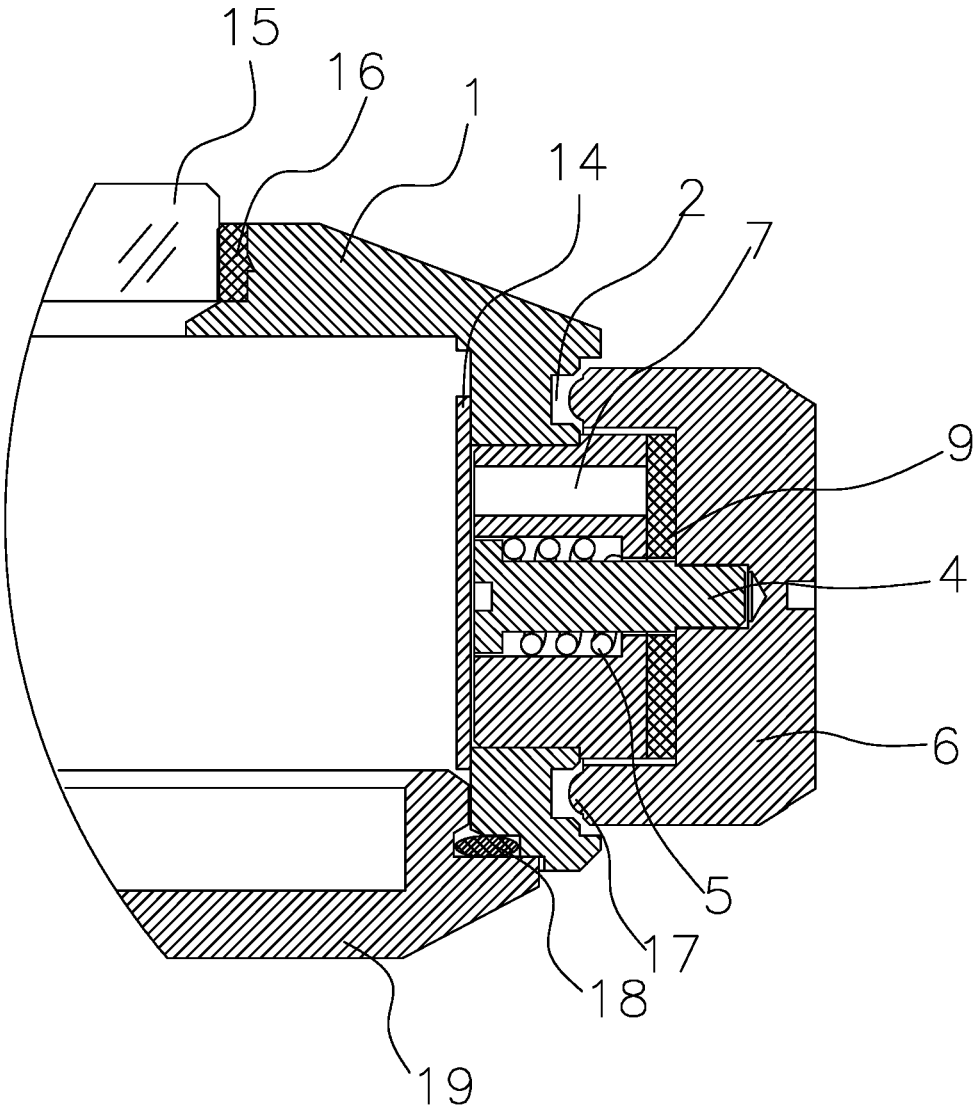
FIG. 5 is a partial cross sectional view of an embodiment of the waterproof smart watch of the present application provided with an adjusting knob for use in deep water.

Referring to the present embodiment of the waterproof smart watch shown in FIGS. 3 and 5, on the basis of the above-mentioned technical scheme, an upper sealing cover of the watch case may be provided with a transparent glass watch cover 15 sealed by a waterproof gasket 16, and a lower sealing cover of the watch case may be provided with a bottom cover 19 sealed by a waterproof gasket 18.

Referring to the present embodiment of the waterproof smart watch shown in FIGS. 1-5, on the basis of the above-mentioned technical scheme and to facilitate rotation of the adjusting knob 10, a slot 13 may be provided on an outer end of the adjusting knob.

Referring to the present embodiment of the waterproof smart watch shown in FIGS. 1-5, on the basis of the above-mentioned technical scheme, the adjusting knob 10 may be provided with "OPEN" and "LOCK" patterns 12. To intuitively determine the status of the adjusting knob, the "OPEN" pattern can be in an upright position and the "LOCK" pattern can be in a toppled position when the communication aperture 11, the small hole 8 and the through-hole 7 are in communication with one another successively. When the communication aperture 11 and the through-hole 7 are sealed and separated by the sealing pad 9, the "LOCK" pattern can be in an upright position and the "OPEN" pattern can be in a toppled position.

The above is a description of the waterproof smart watch of the present application, which is used to assist the understanding of the waterproof smart watch. However, the present application is not limited to the above specific embodiment. It should be noted that any change, modification, substitution, combination, simplification made without departing from the scope of the appended claims are considered to be equivalent replacement within the scope of protection of the appended claims.

What is claimed is:

1. A waterproof smart watch, comprising: a hollow watch case; a cell phone core mounted inside the watch case; a through-hole provided on a lateral side of the watch case and in communication with a microphone of the cell phone core; an adjusting knob rotatably mounted at the lateral side of the watch case, a communication aperture being provided on the adjusting knob and in communication with the through-hole; and a sealing pad provided between the adjusting knob and the watch case, a small hole being provided on the sealing pad and in communication with the through-hole, wherein when the adjusting knob rotates to a position, the communication aperture, the small hole and the through-hole are in communication with one another successively, and further rotation of the adjusting knob renders the communication aperture and the through-hole being sealed and separated by the sealing pad;

wherein an installation opening is provided on the lateral side of the watch case, and a circular tube is installed inside the installation opening, a center of the circular tube being provided with a stepped bore, wherein a large bore of the stepped bore is facing inwards and provided therein with a spring, and a bolt passes through and compresses the spring; the bolt extends from a small bore of the stepped bore and couples with a shaft of the adjusting knob after passing through the sealing pad, the through-hole being provided on the circular tube.

2. The waterproof smart watch as claimed in claim 1, wherein at least two sets of indentations are provided on the lateral side of the watch case surrounding the installation opening, and the adjusting knob is provided with projections that are engageable with one set of the indentations, and when the adjusting knob rotates such that the communication aperture, the small hole and the through-hole are in communication with one another successively, the projections snap into one set of the indentations; and when the adjusting knob rotates such that the communication aperture and the through-hole are sealed and separated by the sealing pad, the projections snap into another set of the indentations.

3. The waterproof smart watch as claimed in claim 1, wherein the adjusting knob is provided with a space facing the watch case and surrounding a portion of the circular tube that exposes out from the watch case.

4. The waterproof smart watch as claimed in claim 1, wherein a waterproof membrane covering the through-hole is provided inside the watch case.

5. The waterproof smart watch as claimed in claim 1, wherein an upper sealing cover of the watch case is provided with a transparent watch cover, and a lower sealing cover of the watch case is provided with a bottom cover.

6. The waterproof smart watch as claimed in claim 1, wherein a slot is provided on an outer end of the adjusting knob.

7. The waterproof smart watch as claimed in claim 1, wherein the adjusting knob is resiliently pressed against a surface of the sealing pad.

8. The waterproof smart watch as claimed in claim 1, wherein the adjusting knob is provided with "OPEN" and "LOCK" patterns, and when the communication aperture, the small hole and the through-hole are in communication with one another successively, the "OPEN" pattern is in an upright position and the "LOCK" pattern is in a toppled position; and when the communication aperture and the through-hole are sealed and separated by the sealing pad, the "LOCK" pattern is in an upright position and the "OPEN" pattern is in a toppled position.

9. The waterproof smart watch as claimed in claim 2, wherein the indentations comprise two sets of perpendicularly disposed indentations, and each set comprises two axially symmetric indentations.

* * * * *